US011676554B2

(12) United States Patent
Huang et al.

(10) Patent No.: US 11,676,554 B2
(45) Date of Patent: Jun. 13, 2023

(54) OPTIMIZING FLICKERING OF A LIQUID CRYSTAL DISPLAY

(71) Applicant: DELL PRODUCTS, LP, Round Rock, TX (US)

(72) Inventors: ChaoKai Huang, Taipei County (TW); Dan Odell Boice, Taipei (TW); MengFeng Hung, Taoyuan (TW); ChingFeng Chen, New Taipei (TW); YiFan Wang, Taipei (TW)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 17/316,092

(22) Filed: May 10, 2021

(65) Prior Publication Data

US 2022/0358890 A1 Nov. 10, 2022

(51) Int. Cl.
*G09G 3/36* (2006.01)

(52) U.S. Cl.
CPC ... *G09G 3/3648* (2013.01); *G09G 2300/0842* (2013.01); *G09G 2310/08* (2013.01); *G09G 2330/021* (2013.01)

(58) Field of Classification Search
CPC ..... G09G 3/3648; G09G 2300/0842; G09G 2310/08; G09G 2330/021; G09G 3/36
See application file for complete search history.

(56) References Cited

U.S. PATENT DOCUMENTS

| | | | | |
|---|---|---|---|---|
| 4,586,039 | A * | 4/1986 | Nonomura | G09G 3/3648 345/210 |
| 8,638,288 | B2 | 1/2014 | Taylor et al. | |
| 2007/0159424 | A1* | 7/2007 | Shen | G09G 3/3648 345/87 |
| 2014/0198093 | A1* | 7/2014 | Nambi | G09G 3/36 345/212 |
| 2015/0248873 | A1* | 9/2015 | Tanaka | G09G 5/18 345/213 |
| 2017/0372671 | A1* | 12/2017 | Wu | G09G 3/3677 |
| 2018/0292943 | A1 | 10/2018 | Files et al. | |
| 2019/0096343 | A1* | 3/2019 | Hou | G09G 3/3655 |
| 2019/0137944 | A1* | 5/2019 | Yamakawa | G09G 3/3648 |
| 2019/0244576 | A1* | 8/2019 | Kwak | G09G 3/3655 |
| 2020/0103717 | A1 | 4/2020 | Chen et al. | |

* cited by examiner

*Primary Examiner* — Jeff Piziali
(74) *Attorney, Agent, or Firm* — Larson Newman, LLP

(57) ABSTRACT

An information handling system includes a timing controller configured to transmit a command for a common voltage of a particular frame rate to a power management circuit. A storage component may store digital information, wherein each digital information is associated with the common voltage of a particular frame rate. The power management circuit supports a variety of common voltage requirements of the liquid crystal display including an ability to select digital information of the digital information that is associated with the common voltage at the particular frame rate stored in the storage component and apply the common voltage at the particular frame rate to the liquid crystal display.

20 Claims, 6 Drawing Sheets

OPTIMIZING FLICKERING OF A LIQUID CRYSTAL DISPLAY

FIELD OF THE DISCLOSURE

The present disclosure generally relates to information handling systems and more particularly relates to optimizing liquid crystal display flickering.

BACKGROUND

As the value and use of information continues to increase, individuals and businesses seek additional ways to process and store information. One option is an information handling system. An information handling system generally processes, compiles, stores, or communicates information or data for business, personal, or other purposes. Technology and information handling needs and requirements can vary between different applications. Thus, information handling systems can also vary regarding what information is handled, how the information is handled, how much information is processed, stored, or communicated, and how quickly and efficiently the information can be processed, stored, or communicated. The variations in information handling systems allow information handling systems to be general or configured for a specific user or specific use such as financial transaction processing, airline reservations, enterprise data storage, or global communications. In addition, information handling systems can include a variety of hardware and software resources that can be configured to process, store, and communicate information and can include one or more computer systems, graphics interface systems, data storage systems, networking systems, and mobile communication systems. Information handling systems can also implement various virtualized architectures. Data and voice communications among information handling systems may be via networks that are wired, wireless, or some combination.

SUMMARY

An information handling system includes a timing controller configured to transmit a command for a common voltage of a particular frame rate to a power management circuit. A storage component may store digital information, wherein each particular digital information is associated with the common voltage of a particular frame rate. The power management circuit supports a variety of common voltage requirements of the liquid crystal display including an ability to select digital information of the digital information that is associated with the common voltage at the particular frame rate stored in the storage component and apply the common voltage at the particular frame rate to the liquid crystal display.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings indicates similar or identical items.

DETAILED DESCRIPTION OF THE DRAWINGS

The following description in combination with the Figures is provided to assist in understanding the teachings disclosed herein. The description is focused on specific implementations and embodiments of the teachings and is provided to assist in describing the teachings. This focus should not be interpreted as a limitation on the scope or applicability of the teachings.

Figure 1:
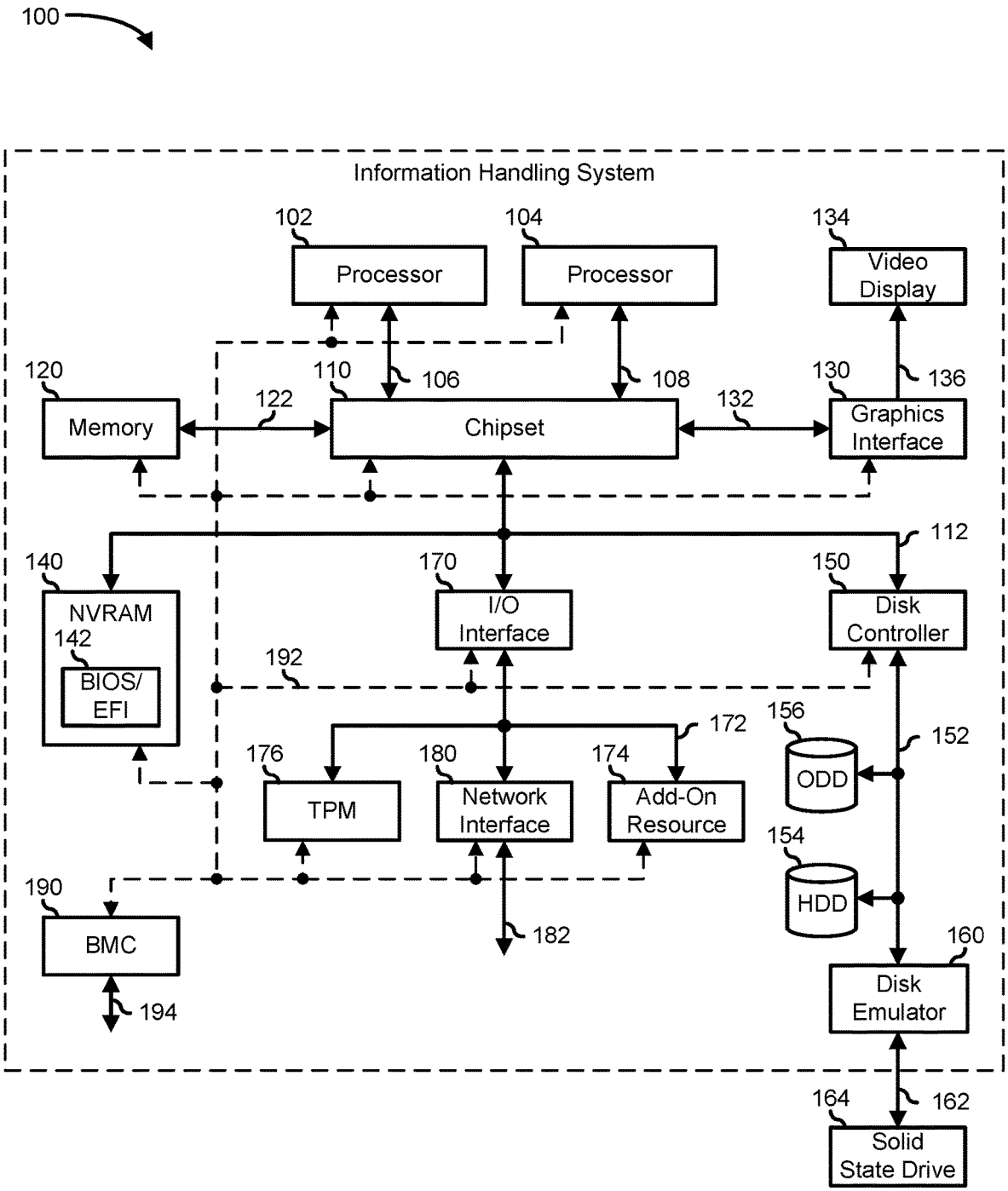
FIG. 1 is a block diagram illustrating an information handling system according to an embodiment of the present disclosure.

FIG. 1 illustrates an embodiment of an information handling system 100 including processors 102 and 104, a chipset 110, a memory 120, a graphics adapter 130 connected to a video display 134, a non-volatile RAM (NV-RAM) 140 that includes a basic input and output system/extensible firmware interface (BIOS/EFI) module 142, a disk controller 150, a hard disk drive (HDD) 154, an optical disk drive 156, a disk emulator 160 connected to a solid-state drive (SSD) 164, an input/output (I/O) interface 170 connected to an add-on resource 174 and a trusted platform module (TPM) 176, a network interface 180, and a baseboard management controller (BMC) 190. Processor 102 is connected to chipset 110 via processor interface 106, and processor 104 is connected to the chipset via processor interface 108. In a particular embodiment, processors 102 and 104 are connected together via a high-capacity coherent fabric, such as a Hyper Transport link, a QuickPath Interconnect, or the like. Chipset 110 represents an integrated circuit or group of integrated circuits that manage the data flow between processors 102 and 104 and the other elements of information handling system 100. In a particular embodiment, chipset 110 represents a pair of integrated circuits, such as a northbridge component and a southbridge component. In another embodiment, some or all of the functions and features of chipset 110 are integrated with one or more of processors 102 and 104.

Memory 120 is connected to chipset 110 via a memory interface 122. An example of memory interface 122 includes a Double Data Rate (DDR) memory channel and memory 120 represents one or more DDR Dual In-Line Memory Modules (DIMMs). In a particular embodiment, memory interface 122 represents two or more DDR channels. In another embodiment, one or more of processors 102 and 104 include a memory interface that provides a dedicated memory for the processors. A DDR channel and the connected DDR DIMMs can be in accordance with a particular DDR standard, such as a DDR3 standard, a DDR4 standard, a DDR5 standard, or the like.

Memory 120 may further represent various combinations of memory types, such as Dynamic Random-Access Memory (DRAM) DIMMs, Static Random-Access Memory (SRAM) DIMMs, non-volatile DIMMs (NV-DIMMs), storage class memory devices, Read-Only Memory (ROM) devices, or the like. Graphics adapter 130 is connected to chipset 110 via a graphics interface 132 and provides a video display output 136 to a video display 134. An example of a graphics interface 132 includes a Peripheral Component Interconnect-Express (PCIe) interface and graphics adapter 130 can include a four-lane (×4) PCIe adapter, an eight-lane (×8) PCIe adapter, a 16-lane (×16) PCIe adapter, or another configuration, as needed or desired. In a particular embodiment, graphics adapter 130 is provided down on a system printed circuit board (PCB). Video display output 136 can include a Digital Video Interface (DVI), a High-Definition Multimedia Interface (HDMI), a DisplayPort interface, or the like, and video display 134 can include a monitor, a smart television, an embedded display such as a laptop computer display, or the like.

NV-RAM 140, disk controller 150, and I/O interface 170 are connected to chipset 110 via an I/O channel 112. An example of I/O channel 112 includes one or more point-to-point PCIe links between chipset 110 and each of NV-RAM 140, disk controller 150, and I/O interface 170. Chipset 110 can also include one or more other I/O interfaces, including a PCIe interface, an Industry Standard Architecture (ISA) interface, a Small Computer Serial Interface (SCSI) interface, an Inter-Integrated Circuit ($I^2C$) interface, a System Packet Interface (SPI), a Universal Serial Bus (USB), another interface, or a combination thereof. NV-RAM 140 includes BIOS/EFI module 142 that stores machine-executable code (BIOS/EFI code) that operates to detect the resources of information handling system 100, to provide drivers for the resources, to initialize the resources, and to provide common access mechanisms for the resources. The functions and features of BIOS/EFI module 142 will be further described below.

Disk controller 150 includes a disk interface 152 that connects the disc controller to a hard disk drive (HDD) 154, to an optical disk drive (ODD) 156, and to disk emulator 160. An example of disk interface 152 includes an Integrated Drive Electronics (IDE) interface, an Advanced Technology Attachment (ATA) such as a parallel ATA (PATA) interface or a serial ATA (SATA) interface, a SCSI interface, a USB interface, a proprietary interface, or a combination thereof. Disk emulator 160 permits SSD 164 to be connected to information handling system 100 via an external interface 162. An example of external interface 162 includes a USB interface, an institute of electrical and electronics engineers (IEEE) 1394 (Firewire) interface, a proprietary interface, or a combination thereof. Alternatively, SSD 164 can be disposed within information handling system 100.

I/O interface 170 includes a peripheral interface 172 that connects the I/O interface to add-on resource 174, to TPM 176, and to network interface 180. Peripheral interface 172 can be the same type of interface as I/O channel 112 or can be a different type of interface. As such, I/O interface 170 extends the capacity of I/O channel 112 when peripheral interface 172 and the I/O channel are of the same type, and the I/O interface translates information from a format suitable to the I/O channel to a format suitable to the peripheral interface 172 when they are of a different type. Add-on resource 174 can include a data storage system, an additional graphics interface, a network interface card (NIC), a sound/video processing card, another add-on resource, or a combination thereof. Add-on resource 174 can be on a main circuit board, on a separate circuit board or add-in card disposed within information handling system 100, a device that is external to the information handling system, or a combination thereof.

Network interface 180 represents a network communication device disposed within information handling system 100, on a main circuit board of the information handling system, integrated onto another component such as chipset 110, in another suitable location, or a combination thereof. Network interface 180 includes a network channel 182 that provides an interface to devices that are external to information handling system 100. In a particular embodiment, network channel 182 is of a different type than peripheral interface 172, and network interface 180 translates information from a format suitable to the peripheral channel to a format suitable to external devices.

In a particular embodiment, network interface 180 includes a NIC or host bus adapter (HBA), and an example of network channel 182 includes an InfiniBand channel, a Fibre Channel, a Gigabit Ethernet channel, proprietary channel architecture, or a combination thereof. In another embodiment, network interface 180 includes a wireless communication interface, and network channel 182 includes a Wi-Fi channel, a near-field communication (NFC) channel, a Bluetooth® or Bluetooth-Low-Energy (BLE) channel, a cellular based interface such as a Global System for Mobile (GSM) interface, a Code-Division Multiple Access (CDMA) interface, a Universal Mobile Telecommunications System (UMTS) interface, a Long-Term Evolution (LTE) interface, or another cellular based interface, or a combination thereof. Network channel 182 can be connected to an external network resource (not illustrated). The network resource can include another information handling system, a data storage system, another network, a grid management system, another suitable resource, or a combination thereof.

BMC 190 is connected to multiple elements of information handling system 100 via one or more management interface 192 to provide out-of-band monitoring, maintenance, and control of the elements of the information handling system. As such, BMC 190 represents a processing device different from processor 102 and processor 104, which provides various management functions for information handling system 100. For example, BMC 190 may be responsible for power management, cooling management, and the like. The term BMC is often used in the context of server systems, while in a consumer-level device a BMC may be referred to as an embedded controller (EC). A BMC included at a data storage system can be referred to as a storage enclosure processor. A BMC included at a chassis of a blade server can be referred to as a chassis management controller and embedded controllers included at the blades of the blade server can be referred to as blade management controllers. Capabilities and functions provided by BMC 190 can vary considerably based on the type of information handling system. BMC 190 can operate in accordance with an Intelligent Platform Management Interface (IPMI). Examples of BMC 190 include an Integrated Dell® Remote Access Controller (iDRAC).

Management interface 192 represents one or more out-of-band communication interfaces between BMC 190 and the elements of information handling system 100, and can include an $I^2C$ bus, a System Management Bus (SMBUS), a Power Management Bus (PMBUS), a Low Pin Count (LPC) interface, a serial bus such as a Universal Serial Bus (USB) or a Serial Peripheral Interface (SPI), a network interface such as an Ethernet interface, a high-speed serial data link such as a PCIe interface, a Network Controller Sideband Interface (NC-SI), or the like. As used herein, out-of-band access refers to operations performed apart from a BIOS/operating system execution environment on information handling system 100, that is apart from the execution of code by processors 102 and 104 and procedures that are implemented on the information handling system in response to the executed code.

BMC 190 operates to monitor and maintain system firmware, such as code stored in BIOS/EFI module 142, option ROMs for graphics adapter 130, disk controller 150, add-on resource 174, network interface 180, or other elements of information handling system 100, as needed or desired. In particular, BMC 190 includes a network interface 194 that can be connected to a remote management system to receive firmware updates, as needed or desired. Here, BMC 190 receives the firmware updates, stores the updates to a data storage device associated with the BMC, transfers the firmware updates to NV-RAM of the device or system that is the subject of the firmware update, thereby replacing the currently operating firmware associated with the device or system, and reboots information handling system, whereupon the device or system utilizes the updated firmware image.

BMC 190 utilizes various protocols and application programming interfaces (APIs) to direct and control the processes for monitoring and maintaining the system firmware. An example of a protocol or API for monitoring and maintaining the system firmware includes a graphical user interface (GUI) associated with BMC 190, an interface defined by the Distributed Management Taskforce (DMTF) (such as a Web Services Management (WSMan) interface, a Management Component Transport Protocol (MCTP) or, a Redfish® interface), various vendor-defined interfaces (such as a Dell EMC Remote Access Controller Administrator (RACADM) utility, a Dell EMC OpenManage Enterprise, a Dell EMC OpenManage Server Administrator (OMSS) utility, a Dell EMC OpenManage Storage Services (OMSS) utility, or a Dell EMC OpenManage Deployment Toolkit (DTK) suite), a BIOS setup utility such as invoked by a "F2" boot option, or another protocol or API, as needed or desired.

In a particular embodiment, BMC 190 is included on a main circuit board (such as a baseboard, a motherboard, or any combination thereof) of information handling system 100 or is integrated onto another element of the information handling system such as chipset 110, or another suitable element, as needed or desired. As such, BMC 190 can be part of an integrated circuit or a chipset within information handling system 100. An example of BMC 190 includes an iDRAC or the like. BMC 190 may operate on a separate power plane from other resources in information handling system 100. Thus BMC 190 can communicate with the management system via network interface 194 while the resources of information handling system 100 are powered off. Here, information can be sent from the management system to BMC 190 and the information can be stored in a RAM or NV-RAM associated with the BMC. Information stored in the RAM may be lost after power-down of the power plane for BMC 190, while information stored in the NV-RAM may be saved through a power-down/power-up cycle of the power plane for the BMC.

Information handling system 100 can include additional components and additional busses, not shown for clarity. For example, information handling system 100 can include multiple processor cores, audio devices, and the like. While a particular arrangement of bus technologies and interconnections is illustrated for the purpose of example, one of skill will appreciate that the techniques disclosed herein are applicable to other system architectures. Information handling system 100 can include multiple central processing units (CPUs) and redundant bus controllers. One or more components can be integrated together. Information handling system 100 can include additional buses and bus protocols, for example, I2C and the like. Additional components of information handling system 100 can include one or more storage devices that can store machine-executable code, one or more communications ports for communicating with external devices, and various input and output (I/O) devices, such as a keyboard, a mouse, and a video display.

For purpose of this disclosure information handling system 100 can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, information handling system 100 can be a personal computer, a laptop computer, a smartphone, a tablet device or other consumer electronic device, a network server, a network storage device, a switch, a router, or another network communication device, or any other suitable device and may vary in size, shape, performance, functionality, and price. Further, information handling system 100 can include processing resources for executing machine-executable code, such as processor 102, a programmable logic array (PLA), an embedded device such as a System-on-a-Chip (SoC), or other control logic hardware. Information handling system 100 can also include one or more computer-readable media for storing machine-executable code, such as software or data.

Liquid crystal display (LCD) panel makers and semiconductor companies are promoting lower or variable refresh rates to achieve power savings. Refresh rate is a number that specifies how many times per second the image on an LCD panel changes. The refresh rate may be given in hertz (Hz). Motion pictures are typically filmed at 24 Hz, while television shows are filmed at 30 Hz or 60 Hz. However, when the LCD panel is running at a lower refresh rate, such as 30 Hz or 20 Hz, a common electrode voltage (VCOM), also referred to as common voltage, is typically acquired at 60 Hz. This may cause flicker and image sticking to become worse if the LCD operates at a lower refresh rate because the frequency or frame rate of the VCOM does not match the refresh rate of the LCD panel. Accordingly, this issue may become a bottleneck for makers of LCD panels to have even lower refresh rates. To address these and other concerns, the present disclosure includes a system and method to acquire and store in a power management integrated circuit (PMIC), the VCOM at the refresh rate that the LCD is targeting to operate that would improve the flicker and image sticking.

Figure 2:
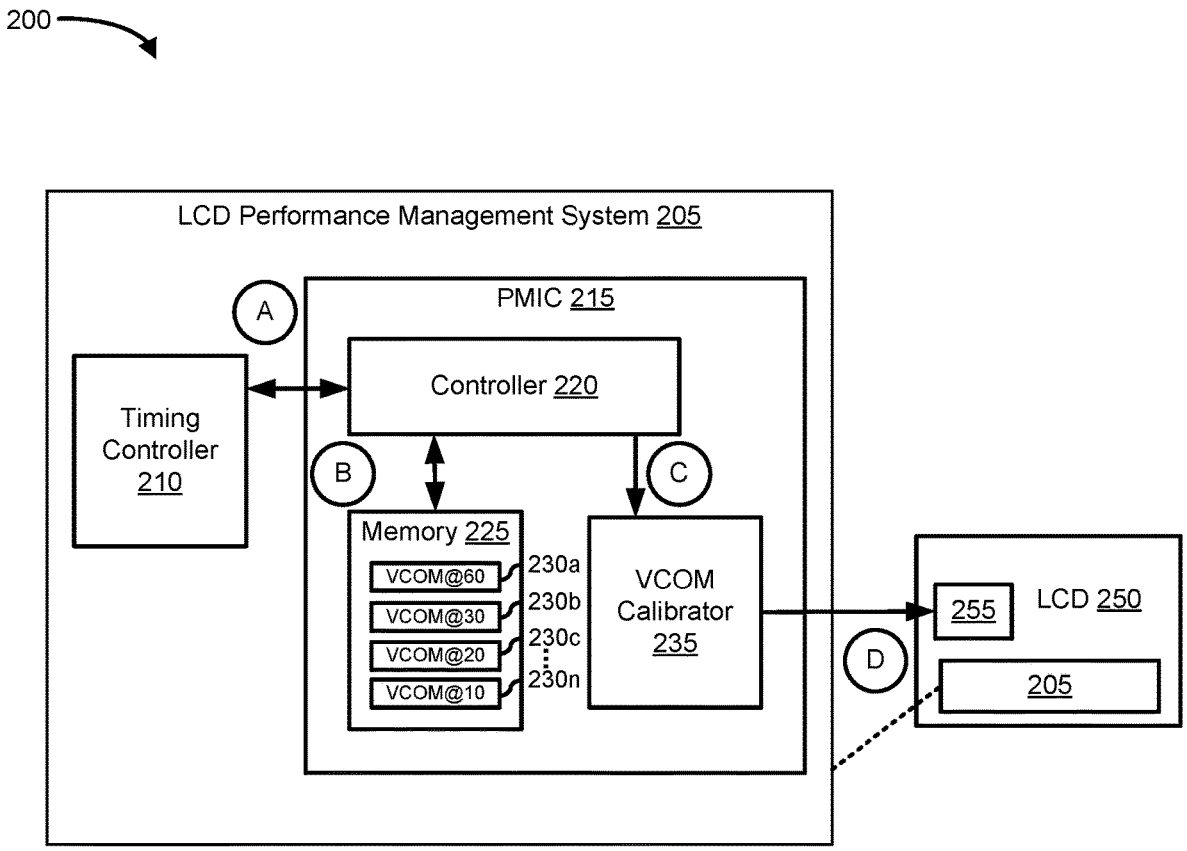
FIG. 2 is a block diagram illustrating an example of a system for optimizing liquid crystal display flickering, according to an embodiment of the present disclosure.

FIG. 2 shows a system 200 for optimizing LCD flickering at various refresh rates. System 200 may be included in an LCD such as an LCD 250 which is associated with an information handling system similar to information handling system 100 of FIG. 1. LCD 250 includes a VCOM plane 255 and an LCD performance management system 205, also referred to as an LCD performance management circuit that includes a timing controller 210 and a PMIC 215 that includes a controller 220, a memory 225, and a VCOM calibrator 235. The components of system 200 may be implemented in hardware, software, firmware, or any combination thereof. The components shown are not drawn to scale and system 200 may include additional or fewer components. In addition, connections between components may be omitted for descriptive clarity.

To prevent image sticking effects, a liquid crystal cell is typically driven by alternating voltages, such as positive and negative voltages. System 200 may be used to improve the flickering of LCD 250 at various refresh rates which may be achieved by adjusting the VCOM. In particular, adjustment of the VCOM may be used to balance the positive and negative voltages and minimize the level of flicker which reduces image stickiness and thus enhance screen images at LCD 250.

LCD performance management system 205 may be configured to acquire a VCOM stored at memory 225 of PMIC 215 at the refresh rate that the LCD 250 is targeting to operate. PMIC 215 may be configured to control the flow and direction of electrical power. PMIC 215 may be configured to manage VCOM for LCD 250. When timing controller 210 determines that LCD 250 is to operate at a lower refresh rate than its current refresh rate, timing controller 210 may transmit a command to controller 220 of PMIC 215 to load the corresponding VCOM, such as one of VCOMs 230*a*-230*n* when moving LCD 250 to a specific lower refresh rate and change the output of VCOM calibrator 235 accordingly.

The command may be transmitted in response to a request from one or more components of information handling system 202, such as a graphics controller. Upon request of the request, timing controller 210 may first determine whether to transmit the command to controller 220 based on the current VCOM at LCD 250. For example, if the request is for a VCOM at 30 Hz but the VCOM at LCD 250 is at 30 Hz, then timing controller 210 may not transmit a command for the VCOM at 30 Hz. Otherwise, timing controller 210 transmits a command for the VCOM at 30 Hz.

PMIC 215 may be configured to fulfill the VCOM voltage requirements of LCD 250 that may include one of VCOM 230*a*-230*n*. The VCOM voltage requirement may change based on the digital information received from timing controller 210 which determines which one of VCOMs 230*a*-230*n* to be passed to LCD 250. VCOMs 230*a*-230*n* may have been pre-determined or preset digital information corresponding to VCOMs that are optimal voltages for various frame rates during manufacture and/or calibration of LCD 350. For example, these can be preset values for 10 Hz, 20 Hz, 30 Hz, etc. If PMIC 215 has not received a command from timing controller 210, then PMIC may apply a default VCOM to LCD 250.

Timing controller 210 may also be configured to determine whether the pixel voltage or VCOM at LCD 250 is unbalanced. The flicker level may be degraded if the pixel voltage of the VCOM is unbalanced when LCD 250 is operating at a various refresh rate which may be lower than 60 Hz. The pixel voltage or VCOM may be unbalanced due to a thin film transistor (TFT) leakage current in the OFF state. If the pixel voltage or VCOM is unbalanced, then timing controller 210 may transmit the command to controller 220. Memory 225 may be a non-volatile storage device such as flash memory and configured to store VCOM 230*a*-230*n* which may be digital information corresponding to a VCOM of a particular frame rate. For example, VCOM 230*a* may correspond to VCOM at 60 Hz, VCOM 230*b* may correspond to VCOM at 30 Hz, VCOM 230*c* may correspond to VCOM at 20 Hz, and VCOM 230*n* may correspond to VCOM at 10 Hz. VCOMs 230*a*-230*n* may be pre-measured VCOMs that may have been stored in a memory in the PMIC during manufacture. VCOM calibrator 235 may be configured to generate the VCOM at the particular frame rate corresponding to the digital information.

FIG. 2 is annotated with a series of letters A-D. Each of these letters represents a stage of one or more operations. Although these stages are ordered for this example, the stages illustrate one example to aid in understanding this disclosure and should not be used to limit the claims. Subject matter falling within the scope of the claims can vary with respect to the order of the operations.

At stage A, when timing controller 210 intends to operate LCD 250 at a particular refresh rate, such as a lower or higher refresh rate than its current refresh rate, it sends a command to controller 220 of PMIC 215 to apply a corresponding pre-measured VCOM during manufacture from memory 225. This may change the VCOM output of VCOM calibrator 235. At stage B, controller 220 fetches digital information such as one of VCOMs 230*a*-230*n* based on the command received from timing controller 210. At stage C, controller 220 sends the digital information to VCOM calibrator 235. At stage D, VCOM calibrator 235 outputs the VCOM to VCOM plane 255 of LCD 250 based on the command received from timing controller 2310.

Those of ordinary skill in the art will appreciate that the configuration, hardware, and/or software components of system 200 depicted in FIG. 2 may vary. For example, the illustrative components within system 200 are not intended to be exhaustive, but rather are representative to highlight components that can be utilized to implement aspects of the present disclosure. For example, other devices and/or components may be used in addition to or in place of the devices/components depicted. The depicted example does not convey or imply any architectural or other limitations with respect to the presently described embodiments and/or the general disclosure. In the discussion of the figures, reference may also be made to components illustrated in other figures for continuity of the description.

Figure 3A:
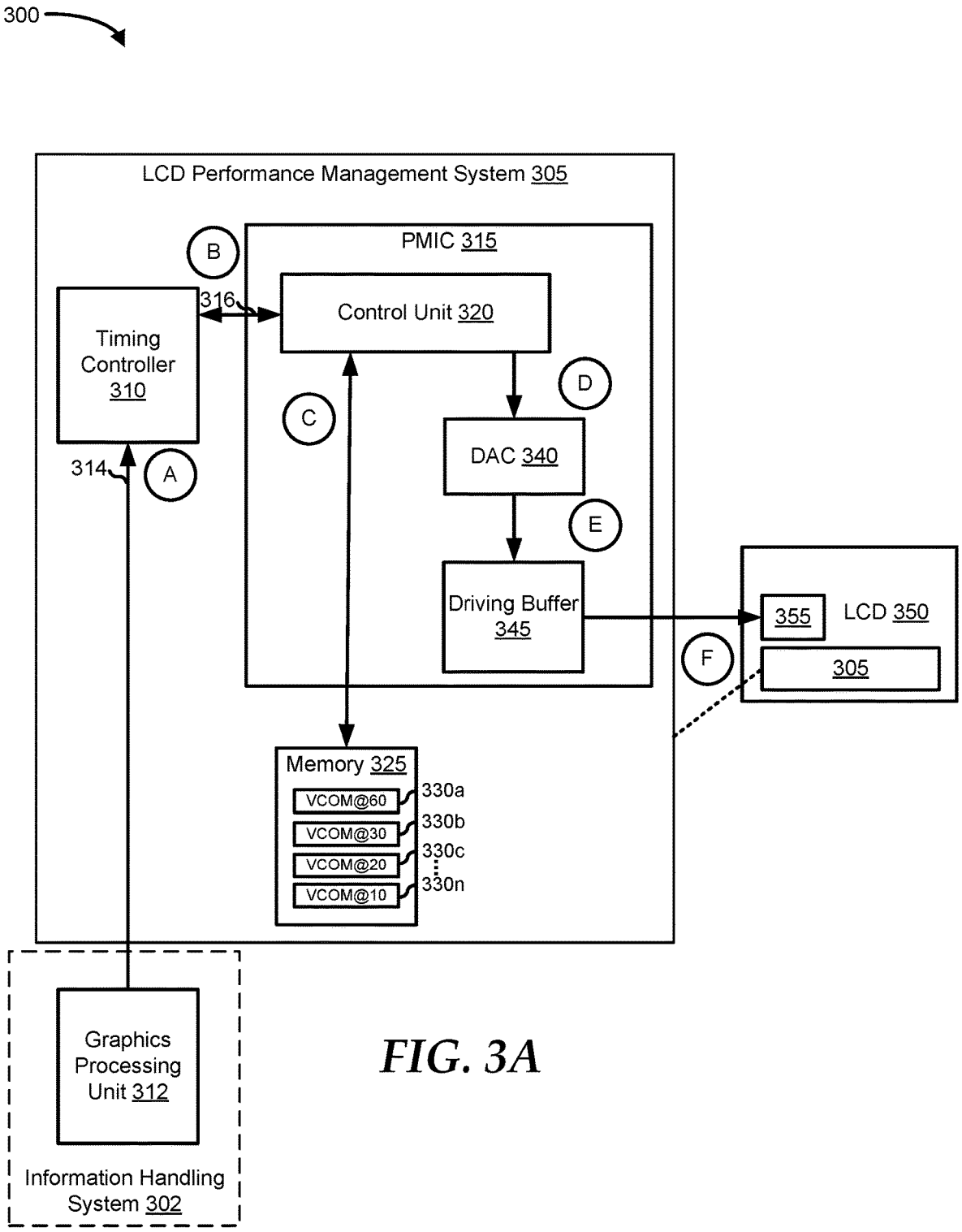
FIG. 3A and FIG. 3B are block diagrams illustrating examples of a system for optimizing liquid crystal display flickering, according to an embodiment of the present disclosure.
Figure 3B:
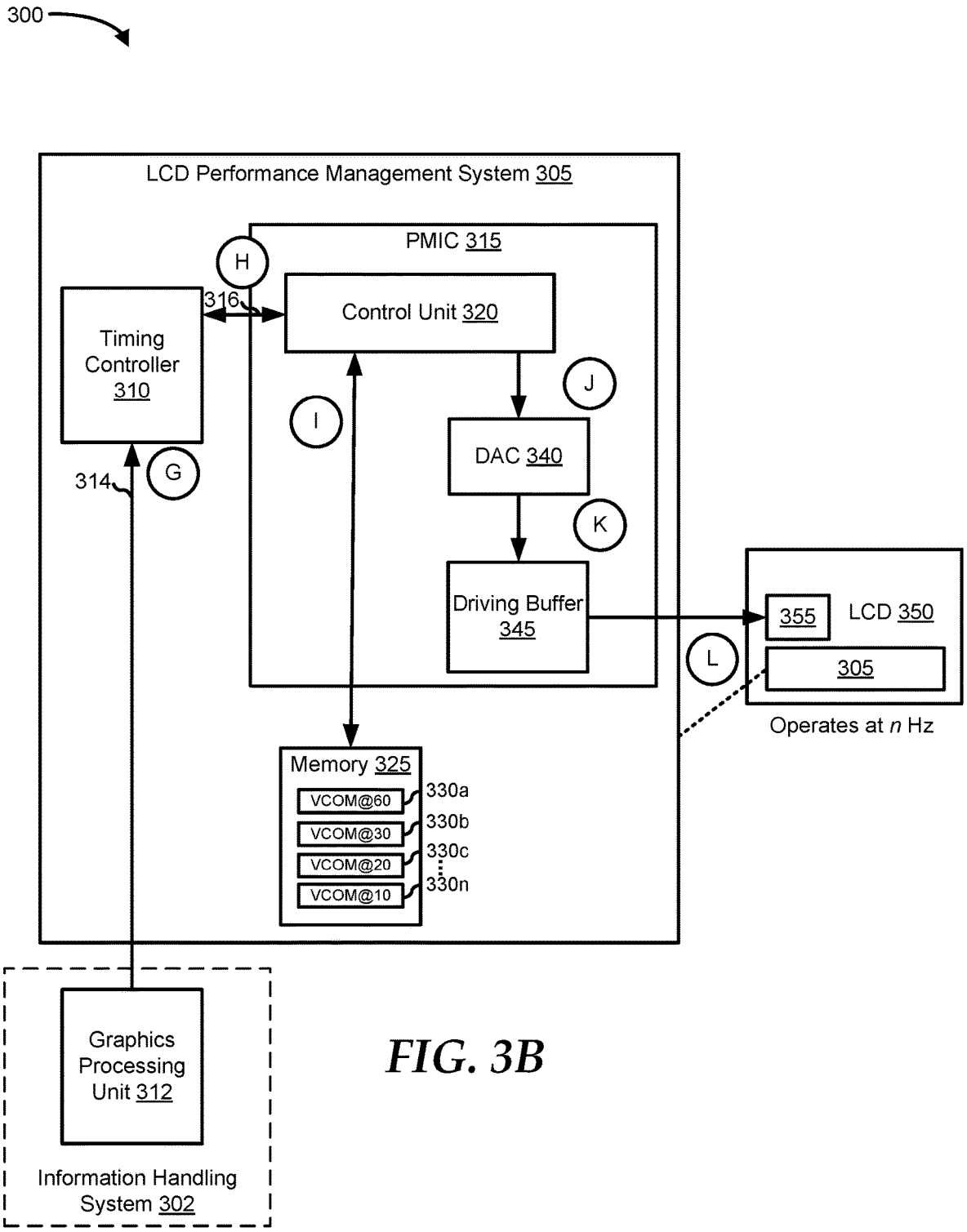

FIG. 3A and FIG. 3B show a system 300 for optimizing LCD flickering at various refresh rates. System 300 is similar to system 200 of FIG. 2. System 300 includes an information handling system 302 and an LCD 350. Information handling system 302, which is similar to information handling system 100 of FIG. 1 includes a graphics processing unit 312. LCD 350 includes a VCOM plane 355 and an LCD performance management system 305 that includes a timing controller 310, a PMIC 315, and a memory 225. PMIC 315 includes a control unit 320, a digital to analog converter (DAC) 340, and a driving buffer 345. The components of system 300 may be implemented in hardware, software, firmware, or any combination thereof. The components shown are not drawn to scale and system 300 may include additional or fewer components. In addition, connections between components may be omitted for descriptive clarity.

Because system 300 is similar to system 200, various components of system 400 may be similar to the components of system 200 of FIG. 2. For example, timing controller 310 is similar to timing controller 210, control unit 420 is similar to controller 220, and memory 325 is similar to memory 225. Similar to system 200 of FIG. 2, system 300 may be used to improve the flickering of LCD 350 at various refresh rates which may be achieved by adjusting the VCOM. LCD performance management system 305 may be configured to acquire a VCOM from PMIC 315 at the refresh rate that the LCD 350 is targeting to operate. When timing controller 310 determines that LCD 350 is to operate at a lower refresh rate than its current refresh rate, timing controller 310 may transmit a command to control unit 320 of PMIC 215 to load the corresponding VCOM, such as one of VCOMs 330*a*-330*n* when moving LCD 350 to a specific lower refresh rate and change the output of driving buffer 345 accordingly.

Graphics processing unit (GPU) 312 is a processor for rendering images in LCD 350. As part of rendering the images, GPU 312 may be configured to transmit a refresh rate based on instructions from a CPU to timing controller 310 via embedded display port (eDP) 314. Driving buffer 345, also referred to as a VCOM buffer, may be a voltage buffer amplifier configured to transfer a voltage such as VCOM from DAC 340 to LCD 350.

FIG. 3A shows system 300 where LCD 350 is operating at a typical refresh rate of 60 Hz while FIG. 3B shows system 300 where LCD 350 is operating at n Hz. LCD 350 may transition from operating at one refresh rate to another refresh rate as shown in the figures. FIG. 3A and FIG. 3B are annotated with a series of letters A-L. Each of these letters represents a stage of one or more operations. Although these stages are ordered for this example, the stages illustrate one example to aid in understanding this disclosure and should not be used to limit the claims. Subject matter falling within the scope of the claims can vary with respect to the order of the operations.

At stage A, GPU 312 may send an instruction regarding the refresh rate for LCD 350 to timing controller 310 via eDP 314. In this example, the refresh rate of LCD 350 is 60 Hz which is typically used by various applications such as when displaying content, scrolling, video playback, etc. At stage B, timing controller 310 sends a command to control unit 320 of PMIC 315 via $I^2C$ 316. The command may include instruction to retrieve a piece of digital information, such as one of VCOM 330*a*-330*n* corresponding to a VCOM for 60 Hz refresh rate, from memory 325. At stage C, control unit 320 retrieves VCOM 330*a* from memory 325. At stage D, control unit 320 transmits the digital information to DAC 340 which converts VCOM 330*a* to the corresponding VCOM at 60 Hz and sends it to driving buffer 345 at stage E. At stage F, driving buffer 345 outputs the VCOM at 60 Hz to LCD 350.

At stage G, GPU 312 may send another instruction regarding the refresh rate of LCD 350 to timing controller 310 via eDP 314. In this example, the refresh rate of LCD 350 may be transitioned to n Hz, where n is greater than or less than 60. In one example, GPU 312 may send an instruction to operate LCD 350 at a lower refresh rate to consume less power when LCD 350 does not need to operate at 60 Hz or greater, such as during idle mode, when displaying static content, during panel self-refresh (PSR) mode, etc. At stage H, timing controller 310 may send a command via $I^2C$ 316 to control unit 320 to fetch the VCOM associated with n Hz. At stage I, control unit 320 retrieves one of VCOM 330*b*— VCOM 330*n* from memory 325. At stage J, control unit 320 transmits the retrieved digital information to DAC 340 which converts the one of VCOM 330*b*— VCOM 330*n* to the corresponding VCOM of n Hz and sends it to driving buffer 345 as input at stage K. At stage L, driving buffer 345 outputs VCOM of n Hz to VCOM plane 355 of LCD 350.

Figure 4:
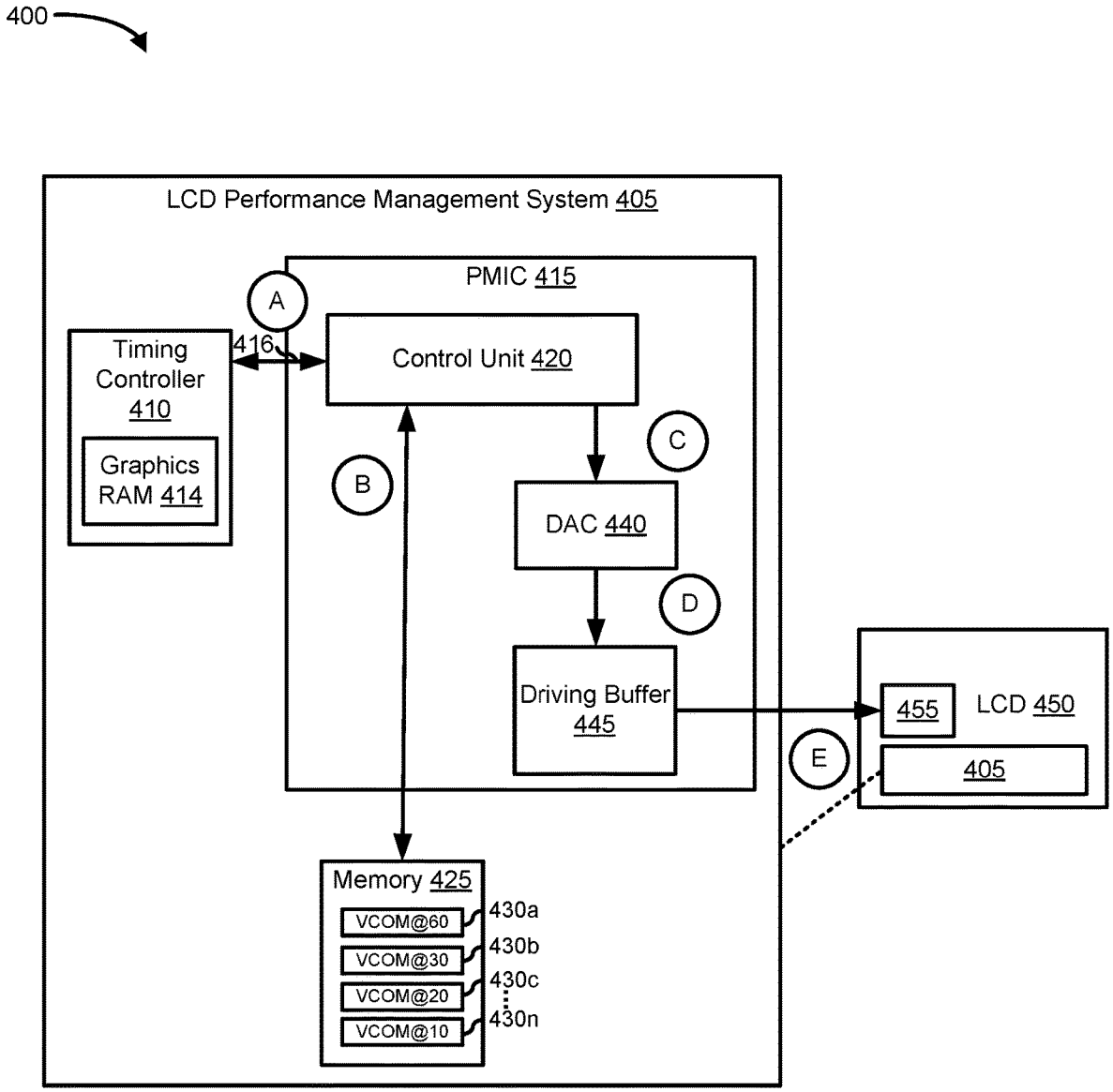
FIG. 4 is a block diagram illustrating an example of a system for optimizing liquid crystal display flickering, according to an embodiment of the present disclosure.

FIG. 4 shows a system 400 for optimizing LCD flickering even at various refresh rates. System 400 is similar to system 200 of FIG. 2 and system 300 of FIG. 3. System 400 includes an LCD 450 that includes VCOM plane 455 and an LCD performance management system 405 that in turn includes a timing controller 410, a PMIC 415, and a memory 425. Timing controller 410 includes a graphics RAM 414. PMIC 415 includes a control unit 420, a DAC 440, and a driving buffer 445. The components of system 400 may be implemented in hardware, software, firmware, or any combination thereof. The components shown are not drawn to scale and system 400 may include additional or fewer components. In addition, connections between components may be omitted for descriptive clarity.

Because system 400 is similar to system 300, various components of system 400 may be similar to the components of system 300 of FIG. 3. For example, timing controller 410 is similar to timing controller 310, control unit 420 is similar to control unit 320, DAC 440 is similar to DAC 340, driving buffer 445 is similar to driving buffer 345, and memory 425 is similar to memory 325. Graphics RAM 414 may be configured to work with timing controller 410 and/or a GPU. Graphics RAM 414 holds information that timing controller 410 and/or the GPU needs such as lighting effects, refresh rates, etc. For example, the graphics RAM 414 may include the refresh rate for LCD 450 based on one or more factors and/or instruction from a graphics controller.

FIG. 4 is annotated with a series of letters A-E. Each of these letters represents a stage of one or more operations. Although these stages are ordered for this example, the stages illustrate one example to aid in understanding this disclosure and should not be used to limit the claims. Subject matter falling within the scope of the claims can vary with respect to the order of the operations.

At stage A, timing controller 310 sends a command via $I^2C$ 416 to control unit 420 based on information at graphics RAM 414. The command may include fetching a VCOM associated with a refresh rate of LCD 450. At stage B, control unit 420 retrieves a piece of digital information which is one of VCOM 430*a*— VCOM 430*n* from memory 425. At stage C, control unit 420 transmits the digital information to DAC 440 which converts the one of VCOM 430*a*— VCOM 430*n* to the corresponding VCOM for the refresh rate of LCD 450 and sends it to driving buffer 345 as input at stage D. At stage E, driving buffer 445 outputs the VCOM to VCOM plane 455 of LCD 450.

Figure 5:
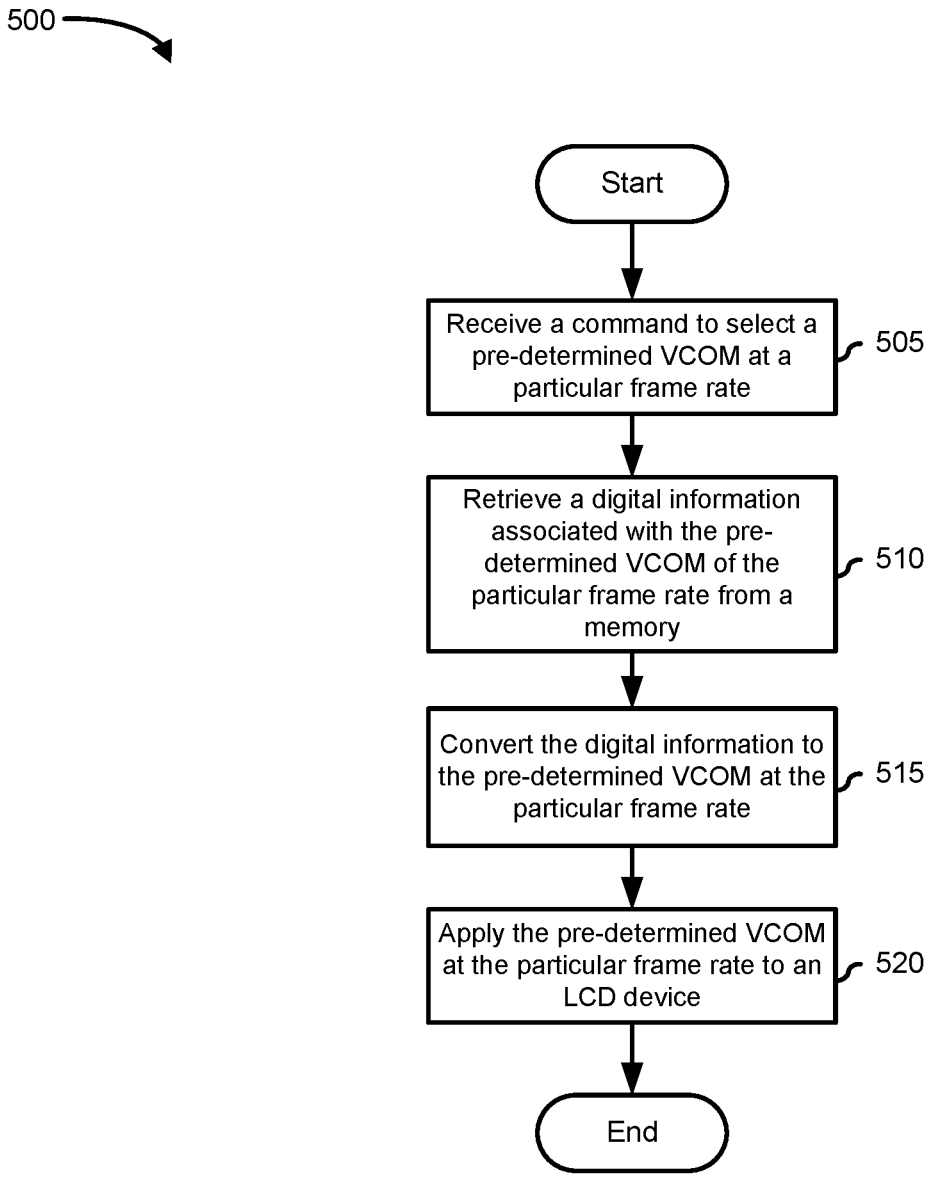
FIG. 5 is a flowchart illustrating an example of a method for optimizing liquid crystal display flickering, according to an embodiment of the present disclosure.

FIG. 5 illustrates a method 500 for optimizing LCD flickering even at various refresh rates. To improve the LCD flickering, method 500 may adjust the VCOM voltage which may be generated by VCOM calibrator 235 of FIG. 2 or DAC 340 of FIG. 3. Method 500 may be performed by one or more components of system 200 of FIG. 2, system 300 of FIG. 3, and system 400 of FIG. 4. However, while embodiments of the present disclosure are described in terms of system 200 of FIG. 2, system 300 of FIG. 3, and system 400 of FIG. 4, it should be recognized that other systems may be utilized to perform the described method. One of skill in the art will appreciate that this flowchart explains a typical example of method 500, which can be extended to advanced applications or services in practice.

Method 500 typically starts at block 505, where a command is received to select a VCOM at a particular frame rate. The command may be received from a timing controller which may be configured to provide a digital control signal to a PMIC whose value may be used to determine which digital information at a memory may be used to generate a corresponding VCOM of a particular frame rate.

At block 510, the method retrieves the particular digital information from memory, wherein the particular digital information is associated with a corresponding VCOM at the particular frame rate of the received command. At block 515, the method converts the digital information to a corresponding VCOM at the particular frame rate. At block 520, the VCOM of the particular frame rate is applied to the LCD. At this point, LCD operates using the VCOM that is optimized for its corresponding refresh rate. The optimization may be performed during the manufacture of the LCD. This prevents the LCD from flickering due to unbalanced pixel voltage and a positive and/or negative polarity frame.

Although FIG. 5 shows example blocks of method 500 in some implementation, method 500 may include additional blocks, fewer blocks, different blocks, or differently arranged blocks than those depicted in FIG. 5. Additionally, or alternatively, two or more of the blocks of method 500 may be performed in parallel.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionalities as described herein.

The present disclosure contemplates a computer-readable medium that includes instructions or receives and executes instructions responsive to a propagated signal; so that a device connected to a network can communicate voice, video, or data over the network. Further, the instructions may be transmitted or received over the network via the network interface device.

While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random-access memory or other volatile re-writable memory. Additionally, the computer-readable medium can include a magneto-optical or optical medium, such as a disk or tapes or another storage device to store information received via carrier wave signals such as a signal communicated over a transmission medium. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

Although only a few exemplary embodiments have been described in detail above, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents but also equivalent structures.

What is claimed is:

1. A hardware liquid crystal display comprising:

a hardware timing controller integrated circuit configured to transmit a command for a common voltage of a corresponding refresh rate to a hardware power management integrated circuit when the hardware timing controller integrated circuit intends to operate the hardware liquid crystal display at a refresh rate, wherein the common voltage is determined at manufacture, and wherein the corresponding refresh rate of the common voltage matches the refresh rate that the hardware liquid crystal display is to operate;

a hardware non-volatile storage device configured to store a plurality of digital information, wherein each digital information is associated with a particular common voltage of a particular refresh rate including the common voltage of the corresponding refresh; and the hardware power management integrated circuit configured to in response to the command, select the digital information from the plurality of digital information and convert the digital information to the common voltage at the corresponding refresh rate and apply to the hardware liquid crystal display.

2. The hardware liquid crystal display of claim 1, wherein the hardware timing controller integrated circuit is configured to transmit the command to the hardware power management integrated circuit in response to a request from a hardware graphics controller integrated circuit.

3. The hardware liquid crystal display of claim 2, wherein the hardware timing controller integrated circuit is configured to determine whether to transmit the command for the common voltage of the corresponding refresh rate based on the request from the hardware graphics controller integrated circuit and a current common voltage applied at the hardware liquid crystal display.

4. The hardware liquid crystal display of claim 1, wherein the hardware timing controller integrated circuit is configured to determine whether a pixel voltage at the hardware liquid crystal display is unbalanced.

5. The hardware liquid crystal display of claim 4, wherein the hardware timing controller integrated circuit is configured to transmit the command to the hardware power management integrated circuit in response to a determination that the pixel voltage at the hardware liquid crystal display is unbalanced.

6. The hardware liquid crystal display of claim 1, wherein the hardware power management integrated circuit is further configured to apply a default common voltage to the hardware liquid crystal display if the command is not received from the hardware timing controller integrated circuit.

7. The hardware liquid crystal display of claim 1, wherein the hardware power management integrated circuit is configured to generate the common voltage of the corresponding refresh rate based on the digital information.

8. The hardware liquid crystal display of claim 1, wherein the hardware non-volatile storage device is a flash memory.

9. A method comprising:

receiving, by a hardware power management integrated circuit, a command for a common voltage of a corresponding refresh rate when a hardware timing controller integrated circuit intends to operate a hardware liquid crystal display device at a refresh rate, wherein the corresponding refresh rate of the common voltage matches the refresh rate that the hardware liquid crystal display device is to operate, and wherein the common voltage is determined at manufacture;

in response to the command, selecting digital information from a plurality of digital information and convert the digital information to the common voltage of the corresponding refresh rate; and applying the common voltage of the corresponding refresh rate to the hardware liquid crystal display device.

10. The method of claim 9, further comprising transmitting the command to the hardware power management integrated circuit in response to a request from a hardware graphics controller integrated circuit.

11. The method of claim 10, determining whether to transmit the command for the common voltage of the corresponding refresh rate based on the request from the hardware graphics controller integrated circuit and a current common voltage applied at the hardware liquid crystal display device.

12. The method of claim 9, further comprising determining whether a pixel voltage at the hardware liquid crystal display device is unbalanced.

13. The method of claim 12, further comprising if the pixel voltage at the hardware liquid crystal display device is unbalanced, then transmitting the command to the hardware power management integrated circuit in response to a determination that the pixel voltage at the hardware liquid crystal display device is unbalanced.

14. The method of claim 9, further comprising applying a default common voltage to the hardware liquid crystal display device if the command is not received from the hardware timing controller integrated circuit.

15. The method of claim 9, further comprising generating the common voltage of the corresponding refresh rate based on the digital information.

16. A non-transitory computer-readable medium including code that when executed performs a method, the method comprising:

receiving a command for a common voltage of a corresponding refresh rate when a hardware timing controller integrated circuit intends to operate a hardware liquid crystal display at a refresh rate, wherein the corresponding refresh rate of the common voltage matches the refresh rate that the hardware liquid crystal display is to operate, and wherein the common voltage is determined at manufacture;

in response to the command, selecting digital information from a plurality of digital information that corresponds to the common voltage of the corresponding refresh rate; and applying the common voltage of the corresponding refresh rate to the hardware liquid crystal display.

17. The method of claim 16, further comprising transmitting the command to a hardware power management integrated circuit in response to a request from a hardware graphics controller integrated circuit.

18. The method of claim 16, further comprising determining whether a pixel voltage at the hardware liquid crystal display is unbalanced.

19. The method of claim 18, further comprising if the pixel voltage at the hardware liquid crystal display is unbalanced, then transmitting the command to a hardware power management integrated circuit in response to a determination that the pixel voltage at the hardware liquid crystal di splay is unbalanced.

20. The method of claim 16, further comprising generating the common voltage of the corresponding refresh rate based on the digital information.

* * * * *